US007515032B2

(12) United States Patent
Koyama et al.

(10) Patent No.: US 7,515,032 B2
(45) Date of Patent: Apr. 7, 2009

(54) COMBINED PTC DEVICE

(75) Inventors: Hiroyuki Koyama, Narita (JP); Arata Tanaka, Ryugasaki (JP)

(73) Assignee: Tyco Electronics Raychem K.K., Kanagawa (JP)

( * ) Notice: Subject to any disclaimer, the term of this patent is extended or adjusted under 35 U.S.C. 154(b) by 175 days.

(21) Appl. No.: 10/562,279

(22) PCT Filed: Jul. 1, 2004

(86) PCT No.: PCT/JP2004/009669

§ 371 (c)(1),
(2), (4) Date: Apr. 21, 2006

(87) PCT Pub. No.: WO2005/004173

PCT Pub. Date: Jan. 13, 2005

(65) Prior Publication Data

US 2006/0244563 A1 Nov. 2, 2006

(30) Foreign Application Priority Data

Jul. 2, 2003 (JP) ..... 2003-190280

(51) Int. Cl.
*H01C 7/10* (2006.01)

(52) U.S. Cl. ..... 338/22 R; 338/295; 338/317

(58) Field of Classification Search ..... 338/22 R, 338/49, 260, 295, 312, 317, 320
See application file for complete search history.

(56) References Cited

U.S. PATENT DOCUMENTS 4,504,817 A * 3/1985 Shikama et al. ..... 338/23
4,544,829 A * 10/1985 Adachi et al. ..... 219/237
4,713,524 A * 12/1987 Leo et al. ..... 392/488
5,140,297 A * 8/1992 Jacobs et al. ..... 338/22 R
5,263,115 A * 11/1993 Kauo et al. ..... 392/444
5,382,938 A * 1/1995 Hansson et al. ..... 338/22 R
5,818,676 A * 10/1998 Gronowicz, Jr. ..... 361/106
5,856,773 A * 1/1999 Chandler et al. ..... 338/22 R
6,593,844 B1 * 7/2003 Iwao et al. ..... 338/22 R
6,606,023 B2 * 8/2003 Chiang et al. ..... 338/22 R

FOREIGN PATENT DOCUMENTS

JP 63-56901 A 3/1988
JP 6-36904 A 2/1994
JP 6-267709 A 9/1994
JP 8-203709 A 8/1996
JP 2002-208504 A 7/2002
JP 3093633 Y1 2/2003

OTHER PUBLICATIONS

International Search Report for International Application No. PCT/JP2004/009669, mailed Oct. 19, 2004.

* cited by examiner

*Primary Examiner*—Kyung Lee

(57) ABSTRACT

A PTC device is provided which is capable of surely functioning as the PTC device even in a wiring through which a large current flows. A combined PTC device (10, 10') is composed of two PTC devices each containing a lamellar PTC element (12, 12') which is composed of a polymeric PTC material and a pair of electrodes (14, 16; and 14', 16') which are arranged apart from each other on one side of the PTC element. The electrodes (14, 16) of one PTC device are respectively opposite to the electrodes (14', 16') of the other PTC device, and terminals (20, 21) are arranged between the respective opposite electrodes. The respective opposite electrodes and the terminal between them are electrically connected with each other.

7 Claims, 2 Drawing Sheets

COMBINED PTC DEVICE

CROSS REFERENCE TO RELATED APPLICATION

The present application claims priority under the Paris Convention based on Japan Patent Application Serial No. 2003-190280 (filing date: Jul. 2, 2003, Title: Composite PTC Device), and is the national stage of International Application No. PCT/JP2004/009669, filed Jul. 1, 2004. The disclosures of each of these are incorporated herein by reference thereto in their entirety.

TECHNICAL FIELD

The present invention relates to a composite PTC device in which a plurality of PTC devices, for example two PTC devices1 are combined, and also to such a PTC device as a protection device for an automobile.

It is noted that as is known in the field of electrical/electronic circuit technology, the "PTC device" denotes a thermistor having a positive temperature coefficient. The PTC device means a device that has a characteristic wherein its electrical resistance (or impedance) is low at a relatively low temperature (for example normal temperature), but increases sharply when the temperature exceeds a certain level (hereinafter, called as a trip temperature). In the present specification, the former state of the PTC device will be referred to as a low state, and the latter state a high state.

BACKGROUND ART

It is well known that currently in an automobile using a normal engine as a power source, safety protection devices each in a fuse-form are necessarily installed in series, for safety in case of emergencies, in circuits for signal lines deployed in an automobiles to transmit signals such as radio operation commands, wiper operation commands, window opening and closing commands, turn signal commands, light switching commands and the like.

In the same way, similar safety protection devices should be installed from the standpoint of safety in an automobile using both a motor and an engine as power sources. Further, a wiring system for transmitting large power for driving the motor, which is to be the driving source, is also installed in the automobile using both the motor and the engine as the power sources. In such a wiring system which transmits such a large power, leakage currents are generated from time to time, which sometimes get into other wiring systems in their proximities.

SUMMARY OF THE INVENTION

Currently in such an automobile using both the motor and the engine as power sources, however, because the leakage currents are generated from time to time from the large power transmission wiring system for driving the motor, which is to be the driving source, and there is a risk of the leak currents being fed into other wiring systems in their proximities, devices similar to the safety protection devices in the signal circuits in the automobile having the normal engine as the power source cannot be used, so that in reality the safety protection devices are not installed in signal circuits. Therefore, the provision of a new PTC device that can function reliably as a PTC device is desired also on wiring in which a large power (or current) flows.

This invention provides a composite PTC device having a plurality of PTC devices each having a laminar PTC element comprising a polymeric PTC material and a pair of electrodes mutually separated and deployed on one side of the PTC element. In this device, the electrodes comprising one electrode from each pair of electrodes on the PTC devices are integrally connected electrically and are also connected to one terminal, while the electrodes comprising the other electrode from each pair of electrodes on the PTC devices are integrally connected electrically and are also connected to another terminal. As a result, current flows through each laminar PTC element when entering the composite PTC device from the outside via said one terminal and exiting therefrom via said other terminal.

In a particularly preferred embodiment, the composite PTC device according to the present invention has two PTC devices (10, 10'), each having a laminar PTC element comprising a polymeric PTC material and a pair of electrodes mutually separated and deployed on one side of the PTC element, wherein the pair of electrodes (14, 16) on one of the PTC devices (10) are face to face with the pair of electrodes (14', 16') on the other PTC device (10'), and the terminals are connected to such facing electrodes respectively (i.e. the terminal 20 is connected to the electrodes 14 and 14', and the terminal 21 is connected to the electrodes 16 and 16'). Preferably, it is characterized that the terminals are deployed between these facing electrodes respectively (i.e. the terminal 20 is deployed between the electrodes 14 and 14', and the terminal 21 is deployed between the electrodes 16 and 16') and the facing electrodes and the terminals between them are connected electrically.

In present specification, the term "composite" is used in order to clarify that the PTC device according to the present invention is formed by electrically connecting a plurality of known PTC devices as described above.

By integrally and electrically connecting the electrodes comprising one electrode from each pair of electrodes on the plurality of PTC devices while also connecting them to one terminal (or lead), and similarly integrally and electrically connecting the electrodes comprising the other electrode from each pair of electrodes on the PTC elements while also connecting them to another terminal (or lead), a plurality of current paths passing through the PTC elements may be ensured in parallel, as a result of which a large power (or current) may be reliably divided into each current path even in a circuit which transmits a large power (or current), so that the composite PTC device as a whole may be used in a circuit which transmits a larger power (or current) than heretofore. For example, the composite PTC device according to the present invention may be used as an automotive protection device that can withstand use under 240VDC or higher (for example 600V). Thus, the present invention also provides a protection device for an automobile comprising the above mentioned composite PTC device.

The PTC device which forms the composite PTC device according to the present invention is well known, and generally comprises a polymeric PTC element (an element formed of a polymer, for example a polyethylene, with a conductive filler such as carbon black dispersed therein),preferably a laminar or sheet-form of such element, and a pair of electrodes, preferably electrode foils, deployed on one side of the polymeric PTC element with a distance between them. The PTC element preferably has a cavity section in order to at least partially absorb the volume increase caused by thermal expansion during the trip and relax the generated stress. This cavity section preferably exists in at least one place selected from the regions of the polymeric PTC element on which regions the electrodes are deployed on their surfaces and their adjacent regions. (In the present specification, the former regions and the latter regions are together referred to as a peripheral region of the electrode.)

It is preferred that the cavity section preferably extends in the thickness direction of the polymeric PTC element, and it is particularly preferred that the cavity section penetrates the polymeric PTC element through in the thickness direction. In particular, one or more cavity sections extend, preferably extend for example penetrating the peripheral region of the electrode (in particular, the region of the polymeric PTC element on which region the electrode is deployed) through the thickness direction. In the case of such penetration through, the end surface of the cavity section is positioned within the peripheral region of the electrode.

The present invention also provides a method of manufacturing a composite PTC device having a plurality of PTC devices each having a laminar PTC element comprising a polymeric PTC material and a pair of electrodes mutually separated and deployed on one side of the PTC element, and is characterized by integrally and electrically connecting the electrodes comprising one electrode from each pair of electrodes on the PTC devices and also connecting them to one terminal, while integrally and electrically connecting the electrodes comprising the other electrode from each pair of electrodes on the PTC devices and also connecting them to other terminal, so that current flows through each laminar PTC element when entering the composite PTC device from the outside via one terminal and exiting therefrom via the other terminal.

In a particularly preferred embodiment, the method of manufacturing the composite PTC device according to the present invention is characterized in that two PTC devices (10, 10') are prepared each having the laminar PTC element comprising the polymeric PTC material and the pair of the electrodes mutually separated and deployed on one side of the PTC element, said one terminal is positioned between one electrode (14) of the pair of electrodes on one of the PTC devices and one electrode (14') of the pair of the electrodes on the other of the PTC devices, and said other terminal is positioned between the other electrode (16) of the pair of electrodes on the one of the PTC devices and the other (16') electrode of the pair of the electrodes on the other of the PTC devices, and the facing electrodes and the terminals between them are connected electrically.

The composite PTC device according to the present invention withstands use under a high voltage energized environment of 240VDC and higher, for example 600VDC. Also, the device can easily ensure safety since the electrodes on each PTC device are positioned on one side of the PTC element so that there is little risk of formation of a short circuit even when a high current and a high voltage are applied causing the device to fail.

Further, when the cavity section is provided in the polymeric PTC element, the number of trips before the device reaches failure (i.e. the number of shifts from the low state to the high state) is increased even when it undergoes thermal expansion through the repeated trips. In other words, the device better withstands a high voltage and the resistance of the device may be maintained at a low resistance. Also, if one of the PTC devices constructing the composite PTC devices reaches failure for some reason, the other PTC device(s) can maintain the operating state since the parallel circuit is formed within the composite PTC device, so that the composite PTC devices according to the present invention can provide the protection devices for an automotive having a high reliability.

Figure 1:
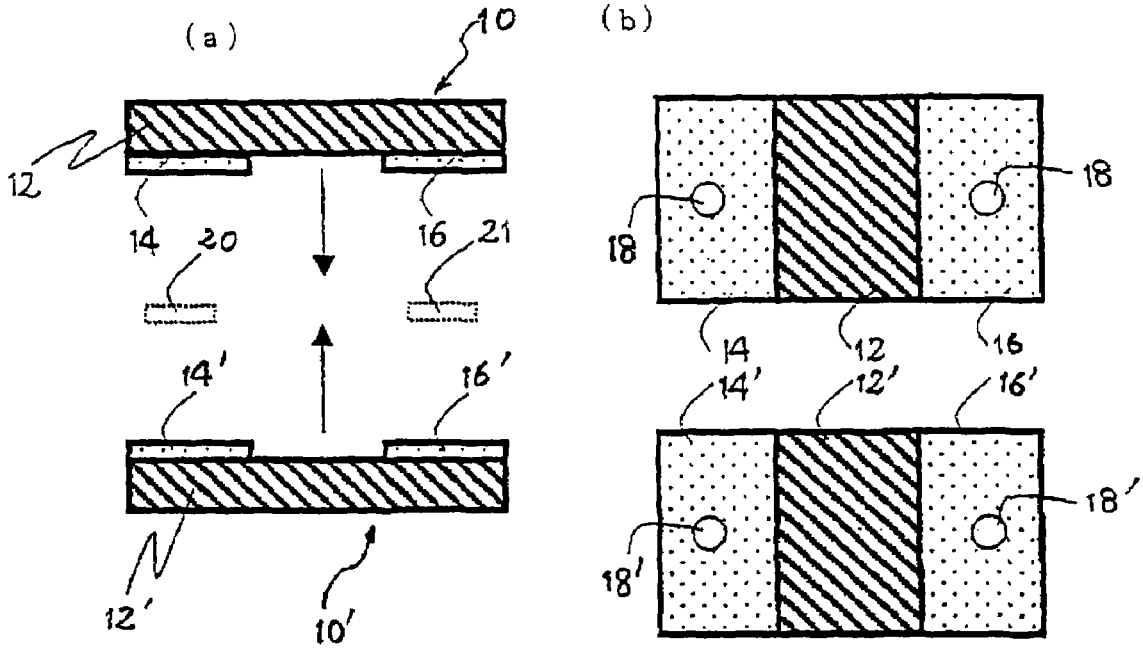
FIG. 1 shows a method of manufacturing a composite PTC device according to the present invention wherein FIG. 1(*a*) is a schematic side view thereof and FIG. 1(*b*) is a schematic plan view thereof.

In the drawings, the reference numbers indicate the following members:

10, 10'=PTC device;
12, 12'=PTC element;
14, 14'=electrode;
16, 16'=electrode;
18, 18'=cavity section;
20, 21=terminal; and
22=solder connection.

DETAILED DESCRIPTION OF THE INVENTION

An example of an embodiment according to the present invention is explained below.

FIG. 1 shows a method of manufacturing a composite PTC device according to the present invention. FIG. 1(*a*) is side views of PTC devices and FIG. 1(*b*) is plan views of the PTC devices. The upper side view and the upper plan view correspond to each other, as do the lower side view and the lower plan view.

A PTC device 10 is prepared which has two electrodes 14 and 16 positioned mutually separated on one side of a sheet-form PTC element 12. A similar PTC device 10' is also prepared. Such PTC devices themselves are already known.

The PTC devices 10 and 10' have cavity sections within the PTC elements 12 and 12', and preferably cavities 18 and 18' penetrating through in the thickness direction of the PTC devices. When the PTC device trips, the PTC element expands thermally; the cavities can at least partially absorb the expansion at that time, as a result of which thermal stress can be relieved. It is noted that the number and the shape of the cavities are not particularly limited in any way as long as they are able to at least partially absorb the thermal expansion. The cavities may also penetrate through the electrodes as illustrated.

Figure 2:
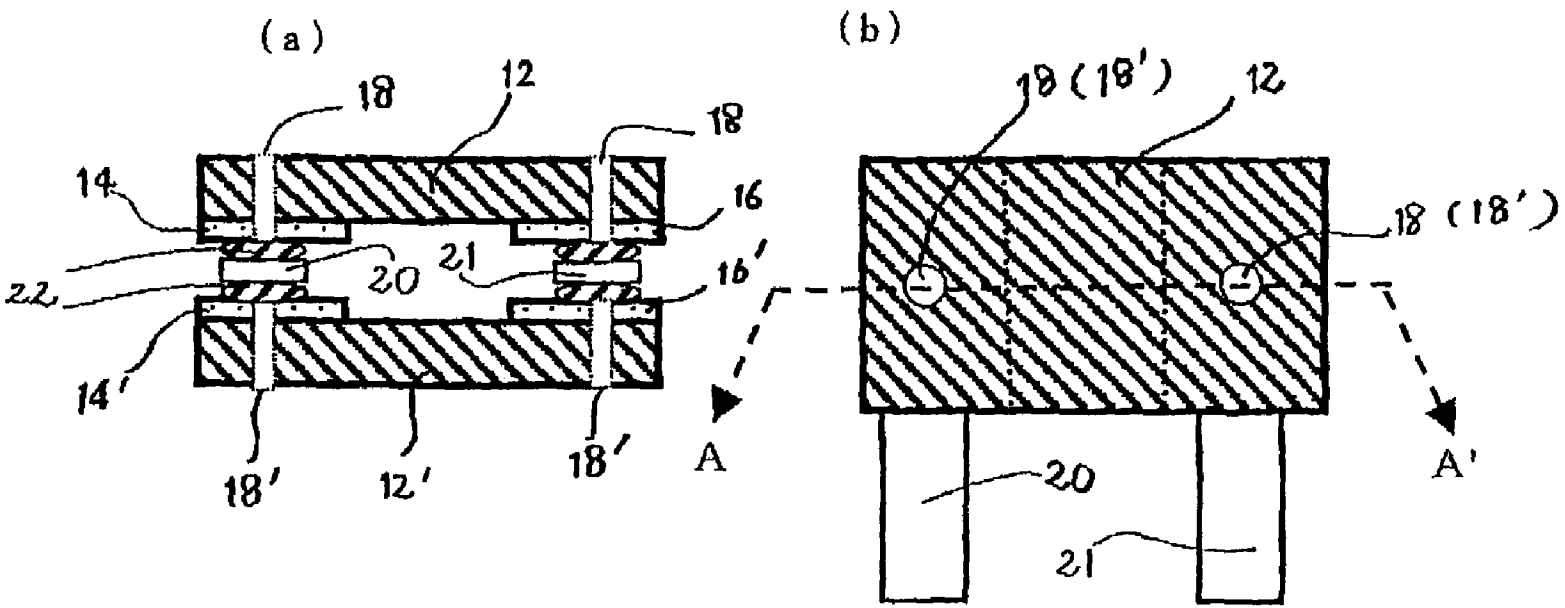
FIG. 2 shows the composite PTC device according to the present invention wherein FIG. 2(*a*) is a schematic cross-sectional view of the composite PTC device according to the present invention and FIG. 2(*b*) is a schematic plan view thereof.

Such PTC devices 10 and 10' are, as shown in FIG. 1(*a*), placed so that each of the electrodes faces one another (the electrode 14 faces the electrode 14' and the electrode 16 faces the electrode 16'); terminals (or leads) 20 and 21 are positioned between the electrodes and these are electrically connected, and thereby the composite PTC device as shown in FIG. 2 is produced. The connection may be made by any suitable method. In the illustrated embodiment, the surfaces of the PTC devices on each of which surfaces the electrodes are placed are made to face each other, and the terminals and the electrodes are electrically bonded by soldering in such a way that the terminals are sandwiched between the facing electrodes.

By combining two PTC devices into one PTC device as described above, the former PTC devices may be connected in parallel, as a result of which the resistance value of the composite PTC device as a whole may be made small. Also, if one of the PTC devices should fail for some reason, the current conducting state may be maintained by the other PTC device, so that a device with high reliability may be constructed.

Specifically, in the illustrated embodiment, electrode foils are each deployed over 3 mm on the two ends of one side of a PTC element whose length×width×thickness is 8 mm×11 mm×1 mm. A plurality of throughholes (one on each electrode side in the illustrated embodiment) having a diameter of 1 mm are formed penetrating the electrode foil and PTC element. Two such PTC devices (10 and 10') are prepared, and 2.7 mm wide×15 mm long×0.8 mm thick terminals (20, 21) are installed between the electrodes (14 and 14', 16 and 16') by means of lead-free soldering.

The material of the terminal may be any material as long as it is electrically conductive, such as copper, iron, nickel, bronze, and the like. Further, there are cases in which it is preferred that such a terminal is provided with surface treatment (for example plating) using tin or nickel.

FIG. 2 shows a finished composite PTC device according to the present invention. FIG. 2(*a*) is a cross-sectional view of the composite PTC device (cross-section along line A-A' in FIG. 2(*b*)), and FIG. 2(*b*) is a plan view of the composite PTC device. For easier understanding, the solder connection 22 positioned between the electrode foil and the terminal is shown exaggeratingly in the illustrated embodiment.

The outward appearance of such a composite PTC device according to the present invention is equivalent to the outer form and size of a safety protection device in the fuse form provided for the safety on the signal circuit deployed in an automobile for transmitting signals such as radio operation commands, wiper operation commands, window opening and closing commands, turn signal commands, or light switching commands; and terminals that are the same as those on the safety protection device are preferably used as the terminals 20 and 21. In this case, the composite PTC device may be used to replace the fuses currently used.

What is claimed is:

1. A composite PTC device having two PTC devices, each having a laminar PTC element comprising a polymeric PTC material and a pair of electrodes mutually separated and deployed on one side of the PTC element, wherein the electrodes comprising one electrode from each pair of the electrodes on the PTC devices are integrally and electrically connected and are also connected to one terminal, while the electrodes comprising the other electrode from each pair of the electrodes on the PTC devices are integrally and electrically connected and are connected to another terminal, the pair of the electrodes on one of the PTC devices is facing the pair of the electrodes on the other PTC device, each of the terminals is deployed between these facing electrodes, and the facing electrodes and the terminals between them are connected electrically.

2. The composite PTC device according to claim 1, which can withstand use under 240VDC or higher and can be used as an automotive safety protection device.

3. The composite PTC device according to claim 2, which can withstand use at 600VDC.

4. The composite PTC device d according to claim 1, wherein current of up to 500 mA flows at 12VDC or 24VDC under a normal use state.

5. The composite PTC device according to claim 1, wherein current flows through each laminar PTC element when entering the composite PTC device from the outside via one terminal and exiting therefrom via the other terminal.

6. The composite PTC device according to claim 1, wherein the laminar PTC element has a cavity section penetrating through a thickness direction of the PTC element.

7. The composite PTC device according to claim 6, wherein an end surface of the cavity section is positioned within a peripheral region of the electrode.

* * * * *